US007637600B2

(12) United States Patent
Yazaki

(10) Patent No.: US 7,637,600 B2
(45) Date of Patent: Dec. 29, 2009

(54) LIQUID EJECTING HEAD AND LIQUID EJECTING APPARATUS INCLUDING THE SAME

(75) Inventor: Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 531 days.

(21) Appl. No.: 11/551,978

(22) Filed: Oct. 23, 2006

(65) Prior Publication Data

US 2007/0091149 A1 Apr. 26, 2007

(30) Foreign Application Priority Data

Oct. 24, 2005 (JP) ..... 2005-309091

(51) Int. Cl.
*B41J 2/045* (2006.01)

(52) U.S. Cl. ..... 347/68

(58) Field of Classification Search ..... 347/68, 347/69–72; 400/124.16
See application file for complete search history.

(56) References Cited

U.S. PATENT DOCUMENTS

2006/0187269 A1* 8/2006 Takahashi ..... 347/68
2006/0192817 A1* 8/2006 Miyata ..... 347/68

FOREIGN PATENT DOCUMENTS

JP 10-226071 8/1998
JP 2001-260357 9/2001

* cited by examiner

*Primary Examiner*—K. Feggins
(74) *Attorney, Agent, or Firm*—Workman Nydegger

(57) ABSTRACT

A liquid ejecting head includes nozzle openings through which a liquid is ejected and a channel-containing substrate having pressure-generating chambers each communicating with the corresponding nozzle openings. Piezoelectric elements are disposed on a side of the channel-containing substrate, and each has a piezoelectric active portion. Each piezoelectric element has a lower electrode, a piezoelectric layer and an upper electrode. A protective film composed of an inorganic insulating material covers the piezoelectric elements. The protective film has exposed portions, each exposing a surface of the upper electrode of the corresponding piezoelectric element. The piezoelectric active portions substantially function as operating portions of the piezoelectric elements.

4 Claims, 5 Drawing Sheets

LIQUID EJECTING HEAD AND LIQUID EJECTING APPARATUS INCLUDING THE SAME

The entire disclosure of Japanese Patent Application No. 2005-309091, filed Oct. 24, 2005 is expressly incorporated by reference herein.

BACKGROUND

1. Technical Field

The present invention relates to a liquid ejecting head for ejecting a liquid and a liquid ejecting apparatus including the liquid ejecting head. In particular, the invention relates to an inkjet recording head and an inkjet recording apparatus including the inkjet recording head, the inkjet recording head including a vibrating plate constituting part of a pressure-generating chamber communicating with a nozzle opening for ejecting ink droplets; and a piezoelectric element disposed on the vibrating plate, and the inkjet recording head ejecting ink droplets by displacement of the piezoelectric element.

2. Related Art

In inkjet recording heads that each include a vibrating plate constituting part of a pressure-generating chamber communicating with a nozzle opening for ejecting ink and that each eject ink from the nozzle opening by deforming the vibrating plate using a piezoelectric element and pressurizing the ink in the pressure-generating chamber, the following two types of heads have been in practical use: a head including a longitudinal-vibration-mode piezoelectric actuator extending and shrinking in the axial direction of the piezoelectric element; and a head including a flexural-vibration-mode piezoelectric actuator.

An example of the head including the actuator operating in the flexural vibration mode is a head including a piezoelectric element produced by forming a uniform piezoelectric material layer over a vibrating plate using a film-forming technique and then separating the resulting piezoelectric material layer into pieces each having a shape corresponding to a pressure-generating chamber using lithography to form separate piezoelectric elements corresponding to the individual pressure-generating chambers. Such a piezoelectric element has a disadvantage that, for example, the element is easily fractured by external environment such as moisture.

For example, Japanese Patent No. 3,552,013 (Patent Document 1, see, page 4, FIG. 4) discloses a head structure for preventing a piezoelectric element from fracturing and for not inhibiting deformation of the piezoelectric element, the head structure including a thin insulating film composed of, for example, a silicon oxide, a silicon nitride, or an organic material and preferably a photosensitive polyimide, and the head covering at least the periphery of the top face of an upper electrode constituting the piezoelectric element and covering side faces of a piezoelectric layer.

For example, JP-A-2001-260357 (Patent Document 2, see pages 5 and 6, FIGS. 7 and 8) a head structure for preventing a piezoelectric element from fracturing and for not inhibiting deformation of the piezoelectric element, the head structure including a protective insulating film that is disposed over the piezoelectric element and that has a thin portion at a region corresponding to a main portion of an upper electrode, the thin portion having a thickness smaller than the other region.

However, in the structure described in Patent Document 1, ends of an upper electrode-exposing region in the longitudinal direction are not defined. In the case where the ends are disposed outside ends of a piezoelectric active portion, which is a substantial driving portion, when the piezoelectric element is deformed in the flexural mode, stress disadvantageously concentrates in the vicinities of the ends of the electrode-exposing region, thereby fracturing the piezoelectric element.

In Patent Document 2, providing the thin portion of the protective film disposed on the surface of the upper electrode can result in the prevention of the fracture due to external environment of the piezoelectric element. However, the thin portion is formed by adjusting etching time, i.e., by half-etching; hence, it is difficult to control the thickness of the thin portion and to produce a piezoelectric element having uniform displacement properties. Furthermore, the thickness of the thin portion can be controlled by further forming the thin portion after the exposure of the surface of the upper electrode. However, the number of production steps of forming the thin portion disadvantageously increases, thus disadvantageously increasing cost and complexity. Moreover, the thin portion disadvantageously reduces the amount of flexural deformation of the piezoelectric element to degrade ink-ejecting properties.

Note that the above-described problems exist in liquid ejecting heads for ejecting liquid other than ink as well as in the inkjet recording heads for ejecting ink.

SUMMARY

An advantage of some aspects of the invention is that a liquid ejecting head that surely prevents the fracture of a piezoelectric element and a liquid ejecting apparatus including the liquid ejecting head.

According to an aspect of the invention, a liquid ejecting head includes nozzle openings through which a liquid is ejected; a channel-containing substrate having pressure-generating chambers each communicating with the corresponding nozzle opening; piezoelectric elements each having a lower electrode; a piezoelectric layer; and an upper electrode, the piezoelectric elements being disposed on a side of the channel-containing substrate and each having a piezoelectric active portion; and a protective film composed of an inorganic insulating material and covering the piezoelectric elements, the protective film having exposed portions each exposing a surface of the corresponding upper electrode ends of each lower electrode in the longitudinal direction being disposed within a region opposite the corresponding pressure-generating chamber to define ends of each piezoelectric active portion in the longitudinal direction, the piezoelectric active portions substantially functioning as operating portions of the piezoelectric elements, and ends of each of the upper electrode and ends of each piezoelectric layer in the width direction being disposed within a region opposite the corresponding pressure-generating chamber to define ends of each piezoelectric active portion in the transverse direction, wherein the distance between each end of each exposed portion in the longitudinal direction and the corresponding end of the corresponding piezoelectric active portion in the longitudinal direction is 50% or more of the width of each upper electrode when the width of each exposed portion is 50% or more of the width of the corresponding upper electrode, and the distance is equal to or longer than the width of each exposed portion when the width of each exposed portion is less than 50% of the width of the corresponding upper electrode.

According to the aspect of the invention, providing the protective film-composed of an inorganic material can prevent the fracture due to external environment such as moisture in air of the piezoelectric element. Furthermore, providing the exposed portions of the protective film can retain liquid-ejecting properties without inhibition of the displacement of the piezoelectric active portion. Moreover, the definition of the ends of the exposed portions on the basis of the ends of the piezoelectric active portions can prevent fractures of the piezoelectric active portions, a vibrating plate, and the like without the reduction in the stiffness of the interface between each piezoelectric active portion and a piezoelectric nonactive portion that does not substantially operate.

According to another aspect of the invention, each end of each exposed portion in the longitudinal direction has a tapered portion in which the width of the exposed portion gradually decreases toward the end of the exposed portion.

In this case, providing the tapered portions in the protective film can disperse the stress applied to the interface between the piezoelectric active portion and the piezoelectric nonactive portion of each piezoelectric element, thereby preventing fractures of the piezoelectric elements, the vibrating plate, and the like.

According to another aspect of the invention, the width of each exposed portion is 25% to 75% of the width of the corresponding upper electrode.

In this case, the protective film surely covers the piezoelectric elements without the inhibition of the displacement of the piezoelectric active portions, thus preventing the fracture due to external environment of the piezoelectric element.

According to another aspect of the invention, a liquid ejecting apparatus including any one of the liquid ejecting heads described above.

In this case, it is possible to produce a liquid ejecting apparatus having improved reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail below on the basis of embodiments.

First Embodiment

Figure 1:
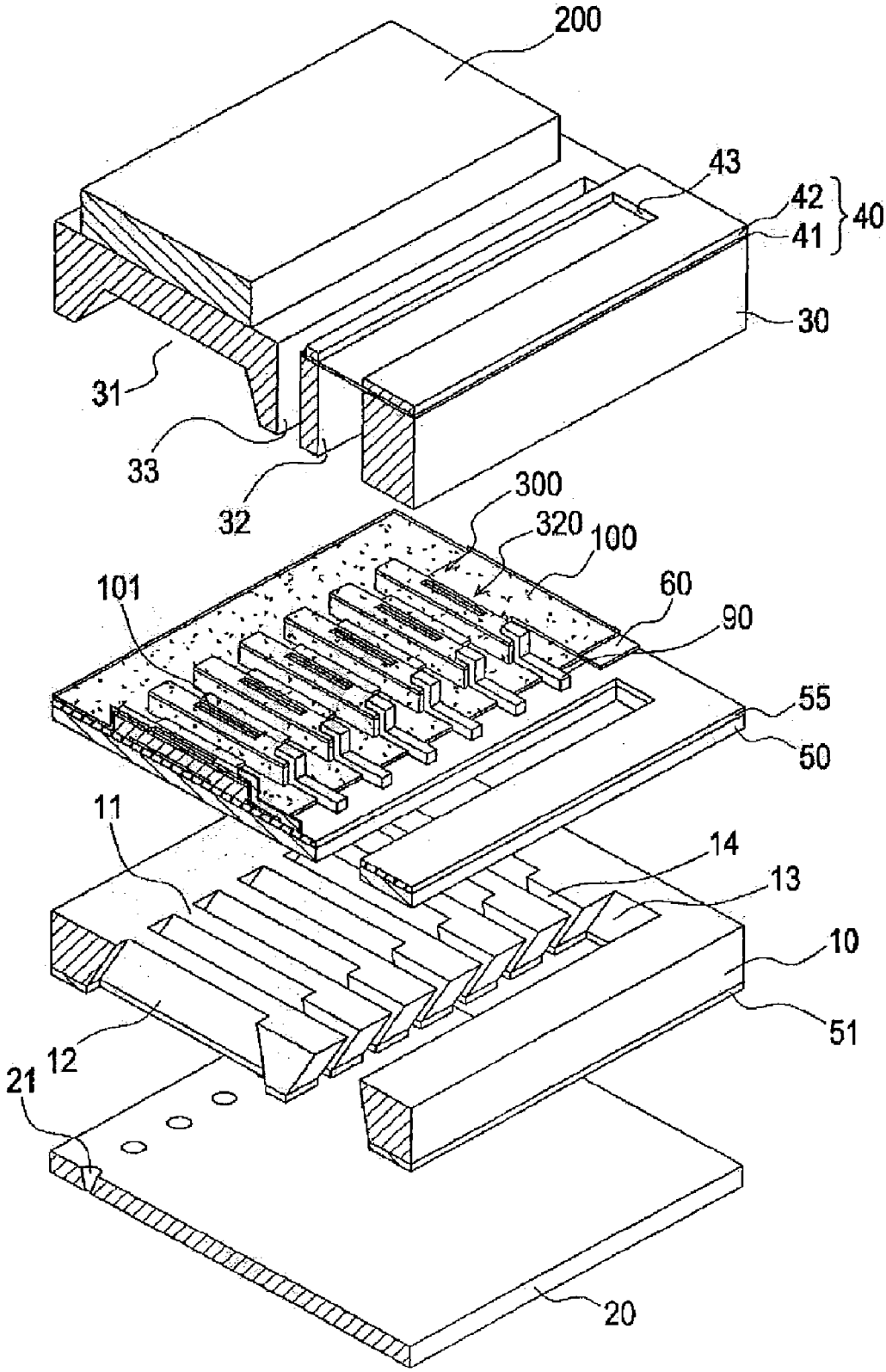
FIG. 1 is a schematic exploded perspective view of the structure of a recording head according to a first embodiment of the invention.
Figure 2:
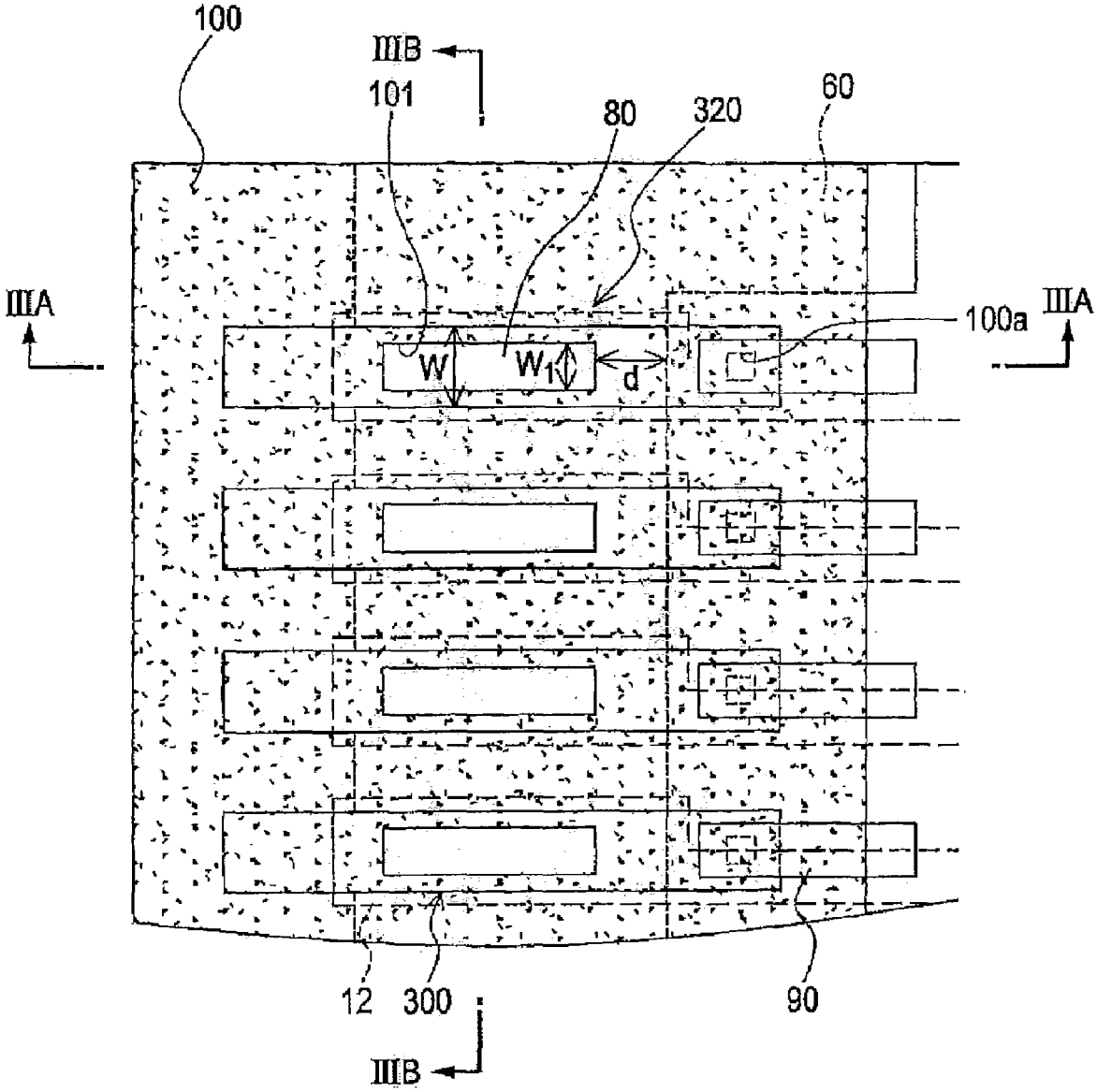
FIG. 2 is a fragmentary plan view of the recording head according to the first embodiment of the invention.
Figure 3A:
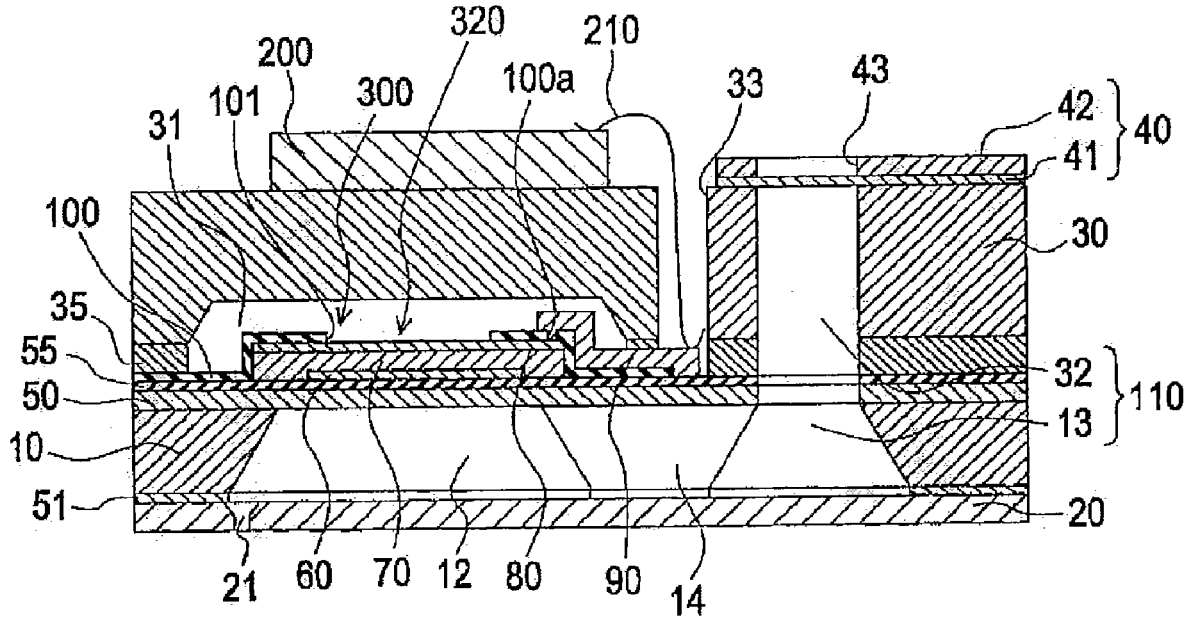
FIGS. 3A and 3B are each a cross-sectional view of the recording head according to the first embodiment of the invention.
Figure 3B:
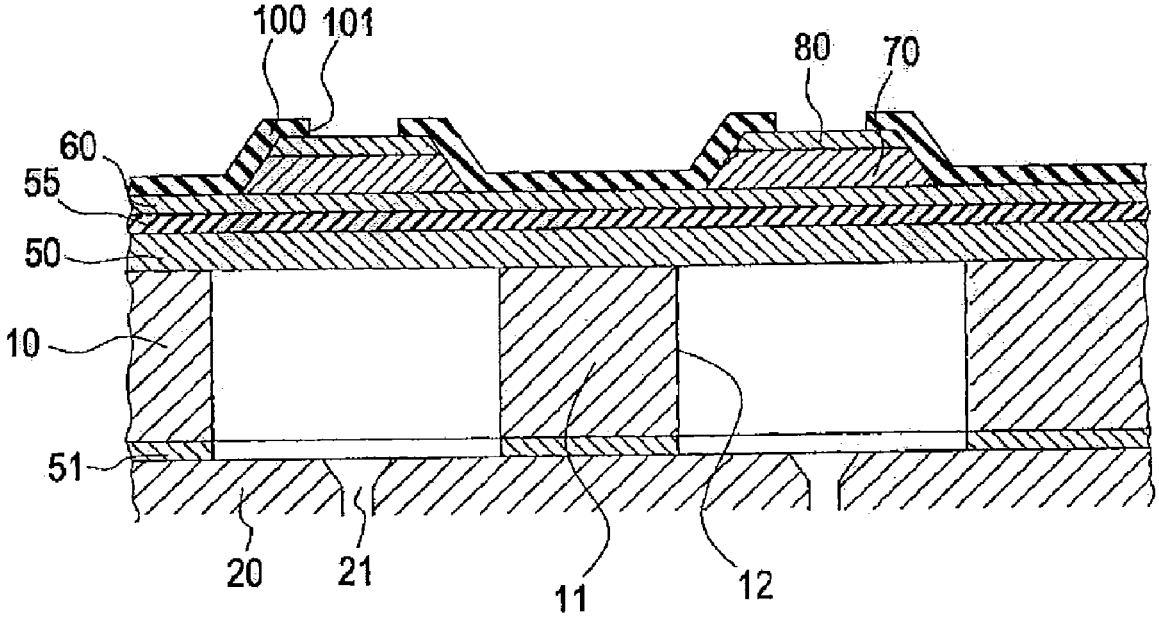

FIG. 1 is a schematic exploded perspective view of the structure of an inkjet recording head according to a first embodiment of the invention. FIG. 2 is a fragmentary plan view of the inkjet recording head. FIG. 3A is a cross-sectional view taken along line IIIA-IIIA in FIG. 2. FIG. 3B is a cross-sectional view taken along line IIIB-IIIB in FIG. 2. As shown in the figures, a channel-containing substrate 10 is formed of a silicon (110) single-crystalline substrate in this embodiment. An elastic film 50 is disposed on one surface of the channel-containing substrate 10. The elastic film 50 has been prepared by thermal oxidation in advance. The elastic film 50 is composed of silicon dioxide and has a thickness of 0.5 to 2 μm. The channel-containing substrate 10 includes a plurality of pressure-generating chambers 12 compartmentalized with partitions 11, the pressure-generating chambers 12 being arranged in the width direction of the pressure-generating chambers 12. The channel-containing substrate 10 includes a communication portion 13 disposed outside the pressure-generating chambers 12 in the longitudinal direction. The communication portion 13 communicates with the pressure-generating chambers 12 through ink feed channels 14 communicating with the respective pressure-generating chambers 12. The communication portion 13 communicates with a reservoir portion of a protective substrate described below to partially constitute a reservoir functioning as a common ink chamber for the pressure-generating chambers 12. The ink feed channels 14 each have a width smaller than the pressure-generating chambers 12 and maintain ink-flow resistance at a predetermined level, the ink flowing from the communication portion 13 into the pressure-generating chambers 12.

A nozzle plate 20 having nozzle openings 21 is bonded to a side of the channel-containing substrate 10 via a mask film 52 described below using an adhesive, a thermal adhesive film, or the like, the nozzle openings 21 each communicating with a portion located in the vicinity of ends of the pressure-generating chambers 12 remote from the ink feed channels 14. The nozzle plate 20 has a thickness of, for example, 0.01 to 1 mm and is composed of a glass-ceramic material, a silicon single crystal, stainless steel, or the like having a linear expansion coefficient of, for example 2.5 to 4.5 ($\times 10^{-6}$/° C.) at temperatures of 300° C. or less.

As described above, the elastic film 50 composed of silicon dioxide and having a thickness of, for example, about 1.0 μm is disposed on the side of the channel-containing substrate 10 remote from the nozzle plate 20. An insulating film 55 composed of zirconium oxide ($ZrO_2$) or the like and having a thickness of, for example, about 0.3 to 0.4 μm is laminated on the elastic film 50. Piezoelectric elements 300 are disposed on the insulating film 55, the piezoelectric elements 300 each including a lower electrode film 60 having a thickness of, for example, about 0.1 to 0.2 μm; a piezoelectric layer 70 having a thickness of, for example, about 0.5 to 5 μm; and an upper electrode film 80 having a thickness of, for example, about 0.05 μm.

The term "piezoelectric elements 300" means a portion including the lower electrode film 60, the piezoelectric layers 709 and the upper electrode films 80. In general, one of the electrodes of each piezoelectric element 300 functions as a common electrode, and the other electrode and each piezoelectric layer 70 corresponding to each pressure-generating chamber 12 are formed by patterning. A portion which is formed of one patterned electrode and each piezoelectric layer 70 and which deforms by applying a voltage to both electrodes is defined as a piezoelectric active portion 320. In this embodiment, the lower electrode film 60 is used as the common electrode for the piezoelectric elements 300, and each upper electrode film 80 is used as an individual electrode for each piezoelectric element 300. However, a converse arrangement due to a driving circuit or an interconnection presents no problem. In any case, each pressure-generating chamber 12 has the piezoelectric active portion 320.

In this embodiment, ends of the lower electrode film 60 in the longitudinal direction of each pressure-generating chamber 12 are disposed within a region opposite the corresponding pressure-generating chamber 12. Thereby, ends of each piezoelectric active portion 320, which functions as a substantial operating portion, in the longitudinal direction are defined. In other words, the length of each piezoelectric active portion 320 is defined. Furthermore, ends of each piezoelectric layer 70 and ends of each upper electrode film 80 in the width direction of each pressure-generating chamber 12 are disposed within a region opposite the corresponding pressure-generating chamber 12. Thereby, ends of each piezoelectric active portion 320 in the transverse direction are defined. In other words, the width of each piezoelectric active portion 320 is defined. That is, each piezoelectric active portion 320 is disposed in only a region opposite the corresponding pressure-generating chamber 12, the region being defined by the patterned lower electrode film 60 and each upper electrode film 80. Moreover, in this embodiment, as shown in FIG. 3B, each piezoelectric layer 70 and each upper electrode film 80 are patterned in such a manner that the width of each piezoelectric layer 70 decreases with proximity to the corresponding upper electrode film 80. The side faces of each piezoelectric layer 70 are inclined faces.

Each piezoelectric element 300 and a vibrating plate that is deformed by operation of the corresponding piezoelectric element 300 are collectively referred to as an "actuator". In this embodiment, the lower electrode film 60 extends across the transverse direction of the transversely aligned piezoelectric elements 300, and the ends of the lower electrode film 60 in the longitudinal direction of each pressure-generating chamber 12 are disposed at positions opposite the pressure-generating chamber 12. In the above-described embodiment, the elastic film 50, the insulating film 55, and the lower electrode film 60 function as a vibrating plate. However, the vibrating plate is not limited thereto. For example, the lower electrode film 60 alone may function as the vibrating plate without the elastic film 50 and the insulating film 55.

The lower electrode film 60, the piezoelectric layers 70, and the upper electrode films 80 (piezoelectric active portions 320) constituting the piezoelectric elements 300 are covered with a protective film 100. Specifically, the protective film 100 covers the side faces of each piezoelectric layer 70 and the periphery of the top face of each upper electrode film 80. That is, the protective film 100 does not cover the main portion of top face of each upper electrode film 80. An exposed portion 101 is disposed to expose the main portion of top face of each upper electrode film 80. Each exposed portion 101 is a rectangular opening through the protective film 100 in the thickness direction and along the longitudinal direction of each piezoelectric element 300. For example, the exposed portions 101 may be formed by forming the protective film 100 over the entire surface of the channel-containing substrate 10 and then selectively patterning the film.

Ends of each exposed portion 101 in the longitudinal direction are disposed inside the ends of each piezoelectric active portion 320 in the longitudinal direction. In other words, each of the ends of each exposed portion 101 in the longitudinal direction is disposed a predetermined distance inside the corresponding end of the lower electrode film 60 in the longitudinal direction of each pressure-generating chamber 12.

As shown in FIG. 2, in the case where the width $W_1$ of each exposed portion 101 is 50% or more of the width W of the corresponding upper electrode film 80, i.e., $W_1 \geqq W/2$, the distance d between each end of each exposed portion 101 in the longitudinal direction and the corresponding end of the corresponding piezoelectric active portion 320 in the longitudinal direction is 50% or more of the width W of each upper electrode film 80, i.e., $d \geqq W/2$. In contrast, in the case where the width $W_1$ of each exposed portion 101 is less than 50% of the width W of the corresponding upper electrode film 80, i.e., $W_1 < W/2$, the distance d is equal to or longer than the width $W_1$ of each exposed portion 101, i.e., $d \geqq W_1$.

The width $W_1$ is preferably 25% to 75% of the width W of each upper electrode film 80. At an excessively small width $W_1$ of each exposed portion 101, the protective film 100 inhibits the deformation of the piezoelectric elements 300 (piezoelectric active portions 320) to degrade ink-ejecting properties, as described in detail below. An excessively large width $W_1$ of each exposed portion 101 may expose the side faces of each piezoelectric layer 70, thereby not preventing the fracture due to external environment, such as moisture in air, of the piezoelectric elements 300. In this embodiment, the width W of each upper electrode film 80 is about 40 μm; hence, the width $W_1$ of each exposed portion 101 is preferably 10 to 30 μm.

Covering the piezoelectric elements 300 with the protective film 100 can prevent the fracture due to moisture in air or the like of the piezoelectric elements 300. The protective film 100 may be composed of a moisture-resistant material. The protective film 100 is preferably composed of an inorganic insulating material, such as silicon oxide ($SiO_x$), tantalum oxide ($TaO_x$), or aluminum oxide ($AlO_x$), and particularly preferably an inorganic amorphous material, such as aluminum oxide ($AlO_x$), e.g., alumina ($Al_2O_3$). The use of the protective film 100 composed of aluminum oxide can sufficiently prevent the permeation of moisture under high-humidity circumstances even when the protective film 100 has a relatively small thickness, i.e., about 100 nm.

Providing the exposed portions 101 in the protective film 100 can appropriately retain the ejecting properties of ink without the inhibition of deformation of the piezoelectric elements 300 (piezoelectric active portions 320). Furthermore, the ends of the exposed portions 101 are defined on the basis of the ends of the piezoelectric active portions 320 as described above. Thus, when stress due to the operation of the piezoelectric active portions 320 concentrates on the interface between the piezoelectric active portion 320 in each piezoelectric element 300 and the corresponding piezoelectric non-active portion that does not substantially operate, fractures due to stress concentration of the piezoelectric elements 300 and the vibrating plate can be prevented without a reduction in stiffness around the interfaces.

In this embodiment, as shown in FIG. 3B, the protective film 100 extends continuously over the plurality of piezoelectric elements 300 (piezoelectric active portions 320). However, the protective film 100 is not limited thereto. For example, the protective film 100 may be disposed on each piezoelectric element 300.

Each lead electrodes 90 are disposed on the protective film 100. One end of each lead electrode 90 is connected to the corresponding upper electrode film 80 through an opening 100*a* disposed in the protective film 100. The other end extends to a point near an end of the channel-containing substrate 10. The end of the extension is connected to a driving circuit, described below, for driving the piezoelectric element via an interconnection.

A protective substrate 30 including a piezoelectric-element-enclosing portion 31 having a cavity expanding to the extent that the motion of the piezoelectric elements 300 is not inhibited is bonded above the piezoelectric elements 300 on the channel-containing substrate 10 using an adhesive 35. The piezoelectric-element-enclosing portion 31 may have a cavity expanding to the extent that the motion of the piezoelectric elements 300 is not inhibited. The cavity may be sealed or not.

The protective substrate 30 includes a reservoir portion 32 opposite the communication portion 13. As described above, the reservoir portion 32 communicates with the communication portion 13 in the channel-containing substrate 10 to form a reservoir 110 functioning as a common ink chamber for the pressure-generating chambers 12. A through hole 33 is disposed between the piezoelectric-element-enclosing portion 31 in the protective substrate 30 and the reservoir portion 32. Part of the lower electrode film 60 and the end of the extension of the lead electrode 90 are exposed in the through hole 33.

A driving circuit 200 for driving the piezoelectric elements 300 is mounted on the protective substrate 30. For example, a circuit board or a semiconductor integrated circuit (IC) may be used as the driving circuit 200. The driving circuit 200 is electrically connected to the lead electrodes 90 through an interconnection 210 formed of conductive wires such as bonding wires.

The protective substrate 30 is preferably composed of a material having substantially the same thermal expansion coefficient, for example, glass or a ceramic material. In this embodiment, the protective substrate 30 is composed of a silicon single crystal, which is the same material as that of the channel-containing substrate 10.

A compliance substrate 40 including a seal film 41 and a stationary plate 42 is bonded on the protective substrate 30. The seal film 41 is composed of a material having flexibility and low stiffness. For example, the seal film 41 is a polyphenylene sulfide (PPS) film having a thickness of 6 μm. One end face of the reservoir portion 32 is sealed with the seal film 41. The stationary plate 42 is composed of a rigid material, such as a metal. For example, the stationary plate 42 is a stainless steel (SUS) plate having a thickness of 30 μm. An opening 43 surrounded by the stationary plate 42 is disposed at a region opposite the reservoir 110. Thus, one end face of the reservoir 110 is sealed with the flexible seal film 41 alone.

In such an inkjet recording head according to this embodiment, ink is fed from an external ink-feeding unit (not shown) to the head. The inside from the reservoir 110 to the nozzle openings 21 is filled with the ink. Then, a voltage in response to a recording signal from the driving circuit is applied between the lower electrode film 60 and each upper electrode film 80 corresponding to each pressure-generating chamber 12 to deform the elastic film 50, the lower electrode film 60, and the corresponding piezoelectric layer 70, thereby increasing pressure in each pressure-generating chamber 12 and ejecting ink droplets from the nozzle openings 21.

Another Embodiment

Figure 4:
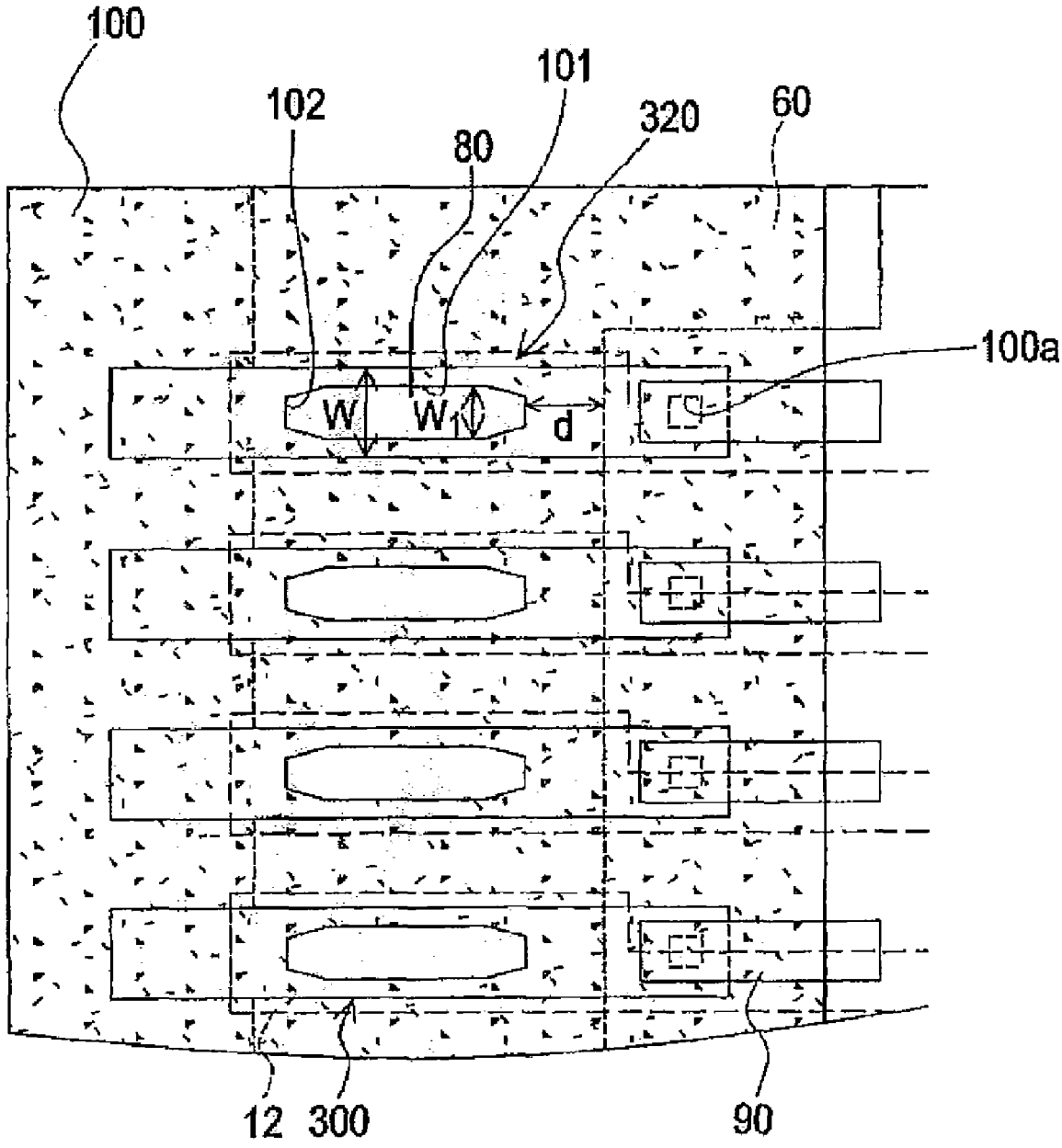
FIG. 4 is a fragmentary plan view of a recording head according to another embodiment of the invention.

While the embodiment of the invention has been described above, the invention is not limited to the embodiment. For example, in the first embodiment described above, the exposed portions 101 each having a rectangular opening are disposed in the protective film 100. However, the shapes of the exposed portions 101 are not limited thereto. Another shape of each exposed portion will now be described with reference to FIG. 4. FIG. 4 is a fragmentary plan view of an inkjet recording head according to another embodiment of the invention. As shown in FIG. 4, a tapered portion 102, in which the width of each exposed portion 101 gradually decreases toward the corresponding end of the exposed portion 101, is disposed at each end of each exposed portion 101 in the longitudinal direction. In this embodiment, each tapered portion 102 has a trapezoidal opening. In this way, providing the tapered portions 102 at the ends of each exposed portion 101 in the longitudinal direction can disperse stress applied to the interface between the piezoelectric active portion 320 of each piezoelectric element 300 and the corresponding piezoelectric nonactive portion, thereby preventing fractures of the piezoelectric elements 300 (piezoelectric active portions 320) and the vibrating plate. Also in the case where each exposed portion 101 includes the tapered portion 102, the distance d between the end of each tapered portion 102 and the corresponding end of the corresponding piezoelectric active portion 320 (end of the lower electrode film 60) is defined on the basis of the width $W_1$ of each exposed portion 101 and the width W of each upper electrode film 80 in the same way as in the first embodiment described above. Furthermore, in the embodiment shown in FIG. 4, each tapered portion 102 has a trapezoidal form. However, the shapes of the tapered portions 102 are not particularly limited thereto. For example, each of the tapered portions 102 may have a triangular form, a circular form, or an ellipsoidal form.

Furthermore, in the first embodiment described above, the protective substrate 30 having the piezoelectric-element-enclosing portion 31 is disposed. However, since the piezoelectric elements 300 are covered with the protective film 100 to prevent fractures due to external environment, a piezoelectric-element-enclosing portion passing through the protective substrate 30 in the thickness direction may be used. Alternatively, the protective substrate may not be disposed.

Figure 5:
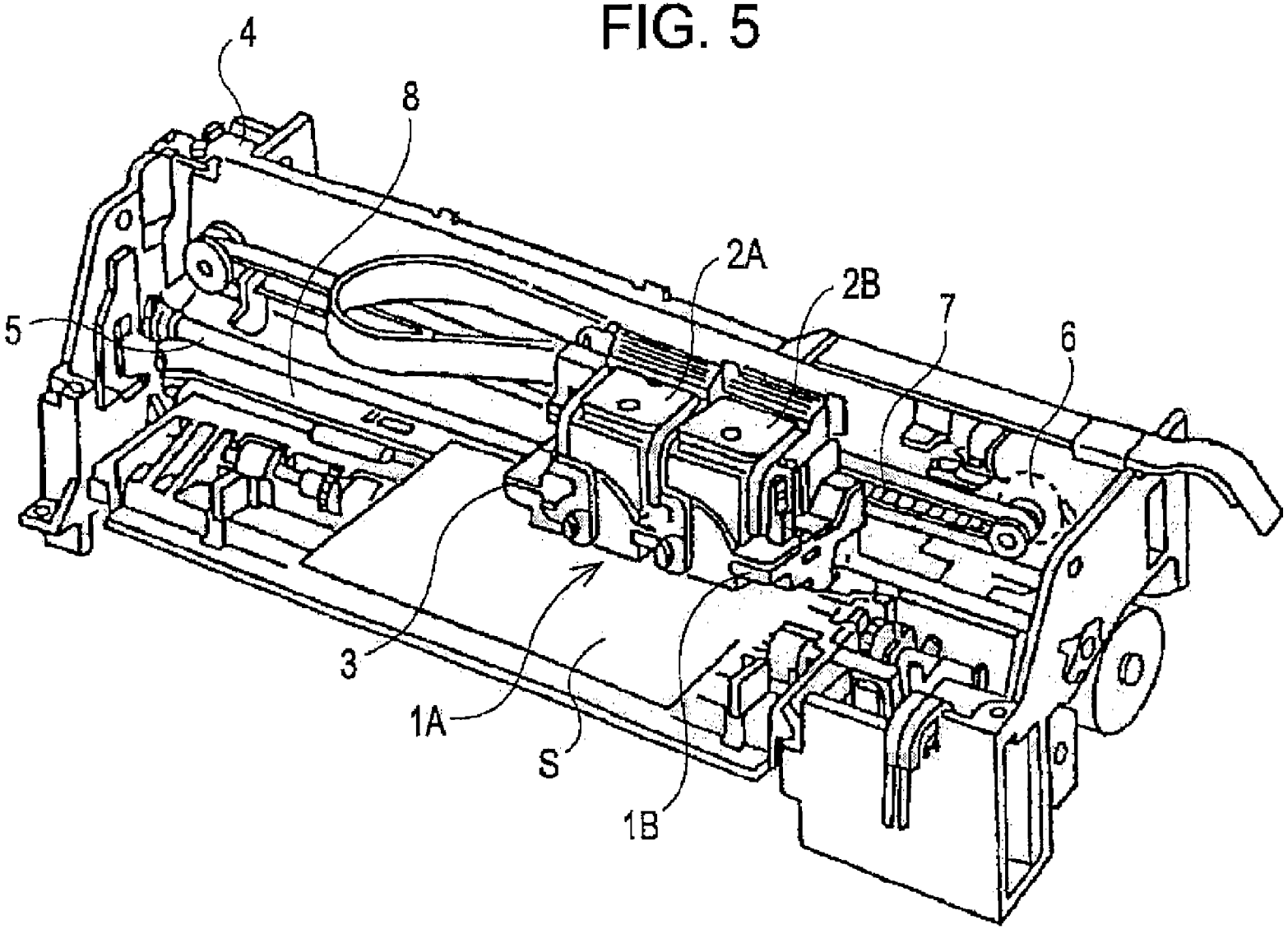
FIG. 5 is a schematic view of an inkjet recording apparatus according to an embodiment of the invention.

The inkjet recording head according to each embodiment partially constitutes a recording head unit having an ink channel communicating with an ink cartridge or the like and is mounted an inkjet recording apparatus. FIG. 5 is a schematic view of an example of the inkjet recording apparatus.

As shown in FIG. 5, a recording head units 1A and 1B provided with inkjet recording heads includes cartridges 2A and 2B having ink feed sections, the cartridges 2A and 2B being detachably disposed. A carriage 3 to which the recording head units 1A and 1B are attached is mounted on a carriage axis 5 fixed to a main body 4 so as to be movable in the axis direction. For example, the recording head units 1A and 1B eject a black-ink composition and a color-ink composition, respectively.

The driving force from a driving motor 6 is transferred to the carriage 3 via a plurality of gears (not shown) and a timing belt 7. Thereby, the carriage 3 to which the recording head units 1A and 1B are attached moves along the carriage axis 5. A platen 8 is disposed on the main body 4 and along the carriage axis 5. A recording sheet S, which is a recording medium such as paper, is fed using a feed roller (not shown) and the like and is transferred with the platen 8.

In the first embodiment described above the inkjet recording head has been described as an example of a liquid ejecting head. The invention can be widely applied to overall liquid ejecting heads and, of course, can also be applied to liquid ejecting heads for ejecting liquid other than ink. Examples of other liquid ejecting heads include various recording heads used for image-recording apparatuses such as printers; colorant-ejecting heads used for the production of color filters used in liquid crystal displays and the like; electrode-forming-material ejecting heads used for forming electrodes of organic electroluminescent (EL) displays and field emission displays (FEDs) (surface emitting displays); and bioorganic-substance-ejecting heads used for the production of biochips. Furthermore, the invention can be applied to not only actuators mounted as pressure-generating units in such liquid ejecting heads but also actuators mounted on all apparatuses. For examples the actuator may be used for a sensor in addition to the head described above.

What is claimed is:

1. A liquid ejecting head comprising:

nozzle openings through which a liquid is ejected;

a channel-containing substrate including:

pressure-generating chambers each communicating with the corresponding nozzle opening;

piezoelectric elements each including:

a lower electrode;

a piezoelectric layer; and an upper electrode, the piezoelectric elements being disposed on a side of the channel-containing substrate and each having a piezoelectric active portion; and a protective film composed of an inorganic insulating material and covering the piezoelectric elements, the protective film including:

exposed portions each exposing a surface of the corresponding upper electrode, ends of each lower electrode in the longitudinal direction being disposed within a region opposite the corresponding pressure-generating chamber to define ends of each piezoelectric active portion in the longitudinal direction, the piezoelectric active portions substantially functioning as operating portions of the piezoelectric elements, and ends of each of the upper electrode and ends of each piezoelectric layer in the width direction being disposed within a region opposite the corresponding pressure-generating chamber to define ends of each piezoelectric active portion in the transverse direction, wherein the distance between each end of each exposed portion in the longitudinal direction and the corresponding end of the corresponding piezoelectric active portion in the longitudinal direction is 50% or more of the width of each upper electrode when the width of each exposed portion is 50% or more of the width of the corresponding upper electrode, and the distance is equal to or longer than the width of each exposed portion when the width of each exposed portion is less than 50% of the width of the corresponding upper electrode.

2. The liquid ejecting head according to claim 1, wherein each end of each exposed portion in the longitudinal direction has a tapered portion in which the width of the exposed portion gradually decreases toward the end of the exposed portion.

3. The liquid ejecting head according to claim 1, wherein the width of each exposed portion is 25% to 75% of the width of the corresponding upper electrode.

4. A liquid ejecting apparatus including the liquid ejecting head according to claim 1.

* * * * *